US008984828B2

(12) United States Patent
Rice

(10) Patent No.: US 8,984,828 B2
(45) Date of Patent: Mar. 24, 2015

(54) BRICK TIE ANCHOR

(71) Applicant: John Rice, Aurora (CA)

(72) Inventor: John Rice, Aurora (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 13/751,732

(22) Filed: Jan. 28, 2013

(65) Prior Publication Data

US 2014/0208681 A1 Jul. 31, 2014

(51) Int. Cl.
*E04B 1/16* (2006.01)
*E04B 1/41* (2006.01)

(52) U.S. Cl.
CPC ..... *E04B 1/4178* (2013.01)
USPC ..... 52/379; 52/712

(58) Field of Classification Search
CPC ..... E04B 1/38; E04B 1/4178; E04B 1/7616; E04B 1/7637; E04B 1/2608
USPC ..... 52/698, 710, 711, 712, 562, 565, 378, 52/379, 713, 714, 715; 403/205, 231; 411/546; 26/2.1
See application file for complete search history.

(56) References Cited

U.S. PATENT DOCUMENTS

| | | | | |
|---|---|---|---|---|
| 5,307,603 | A * | 5/1994 | Chiodo | 52/698 |
| 6,209,281 | B1 * | 4/2001 | Rice | 52/714 |
| 6,941,717 | B2 * | 9/2005 | Hohmann et al. | 52/506.01 |
| 7,415,803 | B2 * | 8/2008 | Bronner | 52/378 |
| 7,562,506 | B2 * | 7/2009 | Hohmann, Jr. | 52/714 |
| 8,037,578 | B2 * | 10/2011 | Megason | 16/438 |
| 2004/0055236 | A1 * | 3/2004 | Keith | 52/410 |
| 2011/0094176 | A1 * | 4/2011 | Bronner | 52/506.05 |
| 2012/0031019 | A1 * | 2/2012 | Stearns et al. | 52/173.3 |
| 2012/0304576 | A1 * | 12/2012 | Hohmann, Jr. | 52/513 |
| 2013/0008121 | A1 * | 1/2013 | Dalen | 52/704 |

* cited by examiner

*Primary Examiner* — Jessica Laux

(57) ABSTRACT

A masonry anchor for tying a masonry veneer wall to a stud back-up wall comprises a generally planar anchor plate of corrosion resistant steel having an outer coupling end for connection to a veneer tie wire and an inner anchoring end for securement to the stud back-up wall. The anchor plate is provided with a plurality of holes through the anchoring end for accepting a fastening means for fastening the anchor to the stud back-up wall. A backing plate of an inert material is provided for positioning between the anchoring end of the anchor plate and the stud back-up wall, the backing plate being provided with raised structures on a face sized to be contained within the holes in the anchoring end of the anchor plate to allow a shank of the fastening means to pass through the raised structure without contacting the anchoring end of the anchor plate.

6 Claims, 5 Drawing Sheets

BRICK TIE ANCHOR

FIELD OF THE INVENTION

The present invention relates to masonry anchors for tying a mason veneer to a stud backup wall in a cavity wall and more particularly to masonry anchors having greatly increased resistance to corrosion.

BACKGROUND OF THE INVENTION

Cavity walls of a masonry veneer tied to a stud backup wall are commonly utilized in construction to provide for esthetically pleasing appearance while being less expensive than solid masonry walls. One common type of cavity wall used in both residential and commercial buildings is a brick veneer tied to a stud backup wall.

The brick veneer is tied to the stud backup wall by use of masonry or brick veneer anchors. Such anchors are generally a planer anchor plate which is attached to the stud of the stud backup wall. The anchor plate at the exposed end is provided with a slot through which a brick tie wire is inserted, the brick tie wire being mortared between two rows of bricks to provide a secure connection between the brick veneer and backup wall. In the past, these connectors have been made of galvanized carbon steel which is a material similar to that which is used in construction of metal studs for the stud backup wall. However, there has recently been a serious concern expressed by a number of agencies regarding the potential for corrosion or failure of the masonry anchors due to the exposure of the anchors to moisture which is present in the cavity between the stud backup wall and the masonry veneer. Thus the use of stainless steel masonry anchors is becoming more prevalent. The problem with the use of the stainless steel anchors is the dissimilarity in metal composition between the stud and the masonry anchor. While the stainless steel anchor and brick tie wire has reduced the potential for corrosion of the anchors between the stud backup wall and the masonry veneer the dissimilar metals contact between the anchor and the stud of the stud backup wall may result in problems of corrosion and weakening of the attachment of the anchor to the stud backup wall.

There thus remains a need for a masonry anchor which overcomes this difficulty.

SUMMARY OF THE INVENTION

The present invention provides for a masonry anchor for tying a masonry veneer wall to a stud back-up wall. The anchor comprises a generally planar anchor plate of corrosion resistant steel having an outer coupling end for connection to a veneer tie wire and an inner anchoring end for securement to the stud back-up wall. The anchor plate is provided with a plurality of holes therethrough in the inner anchoring end for accepting a fastening means for fastening the anchor to the stud back-up wall. A backing plate of an inert material is provided for positioning between the inner anchoring end of the anchor plate and the stud back-up wall, the backing plate being provided with raised structures on a face thereof sized to be contained within the holes in the inner anchoring end of the anchor plate to allow a shank of the fastening means to pass through the raised structure without contacting the inner anchoring end of the anchor plate.

In an aspect of the invention, the backing plate is provided with upwardly and downwardly extending tabs on an upper and lower edge respectively at a forward end of the backing plate for engaging an outer covering of the stud back-up wall to provide for proper spacing of the coupling end of the connected anchor plate from the stud back-up wall.

In another aspect of the invention, the corrosion resistant steel is stainless steel.

BRIEF DESCRIPTION OF THE DRAWINGS

Preferred embodiments of the present invention are illustrated in the attached drawings in which.

DETAILED DESCRIPTION OF THE PREFERRED EMBODIMENTS

Figure 1:
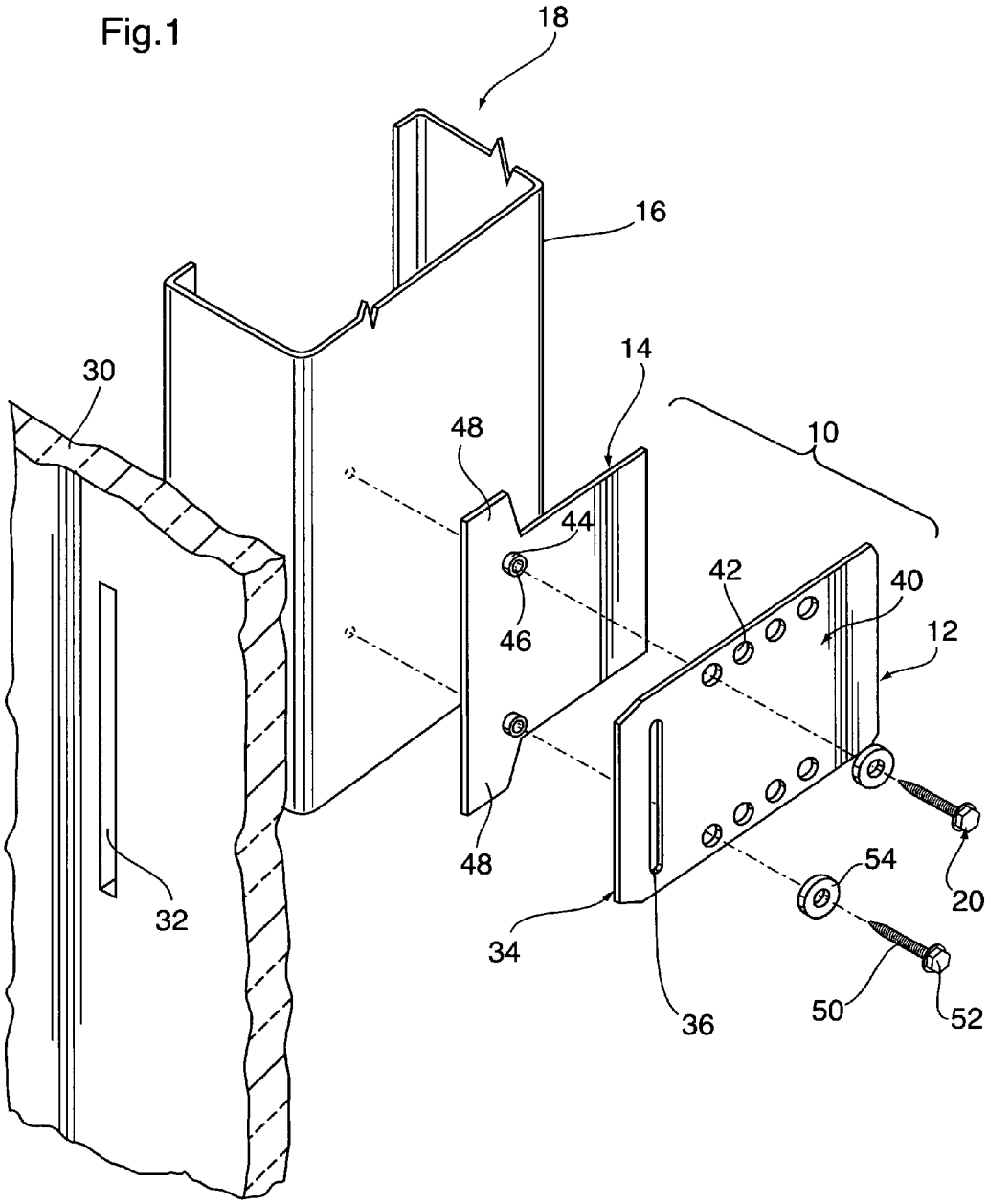
FIG. 1 is an exploded perspective view of a masonry anchor of the present invention.

A first preferred embodiment of the masonry anchor according to the present invention is illustrated in FIGS. 1 through 7. The masonry anchor of this embodiment is particularly for use as a brick veneer anchor and is shown in the figures generally indicated by the numeral 10. The masonry anchor 10 comprises an anchor plate 12 of a corrosion resistant metal and a backing plate 14 of an inert material for positioning between the anchor plate 12 and the stud backup wall, the details of both of which will be described further herein below.

The brick veneer anchor 10 is attached to a stud 16 of a stud backup wall 18 by means of suitable fastening means 20 to tie a brick veneer wall 22 constructed of a number of individual bricks 24 to the backup wall 18. Bricks 24 are mortared together by the use of mortar 26 to form the brick veneer wall 22. The brick veneer wall 22 is spaced from the stud backup wall 18 to provide an intermediate air space or cavity 28.

As illustrated in the figures, the stud wall 18 is composed of a plurality of studs 16 to which an outer covering 30 is attached. During construction of the stud backup wall 18, the studs 16 are placed in position and the outer covering 30 is attached to the studs 16 to form the stud backup wall 18. A number of slots 32 are cut in the outer covering 30 adjacent the studs 16 to provide for openings through which the anchor plate 12 of the masonry veneer anchor 10 may be inserted as will be described below.

The anchor plate 12 is comprised of a generally planer body manufactured from stainless steel to resist the corrosion effects of the environment of the cavity 28. The anchor plate 12 has an outer coupling nose or end 34 having a vertically extending slot 36 for connection to a veneer tie wire 38 and an inner anchoring end 40 for securing the anchor plate 12 to the stud 16.

Figure 2:
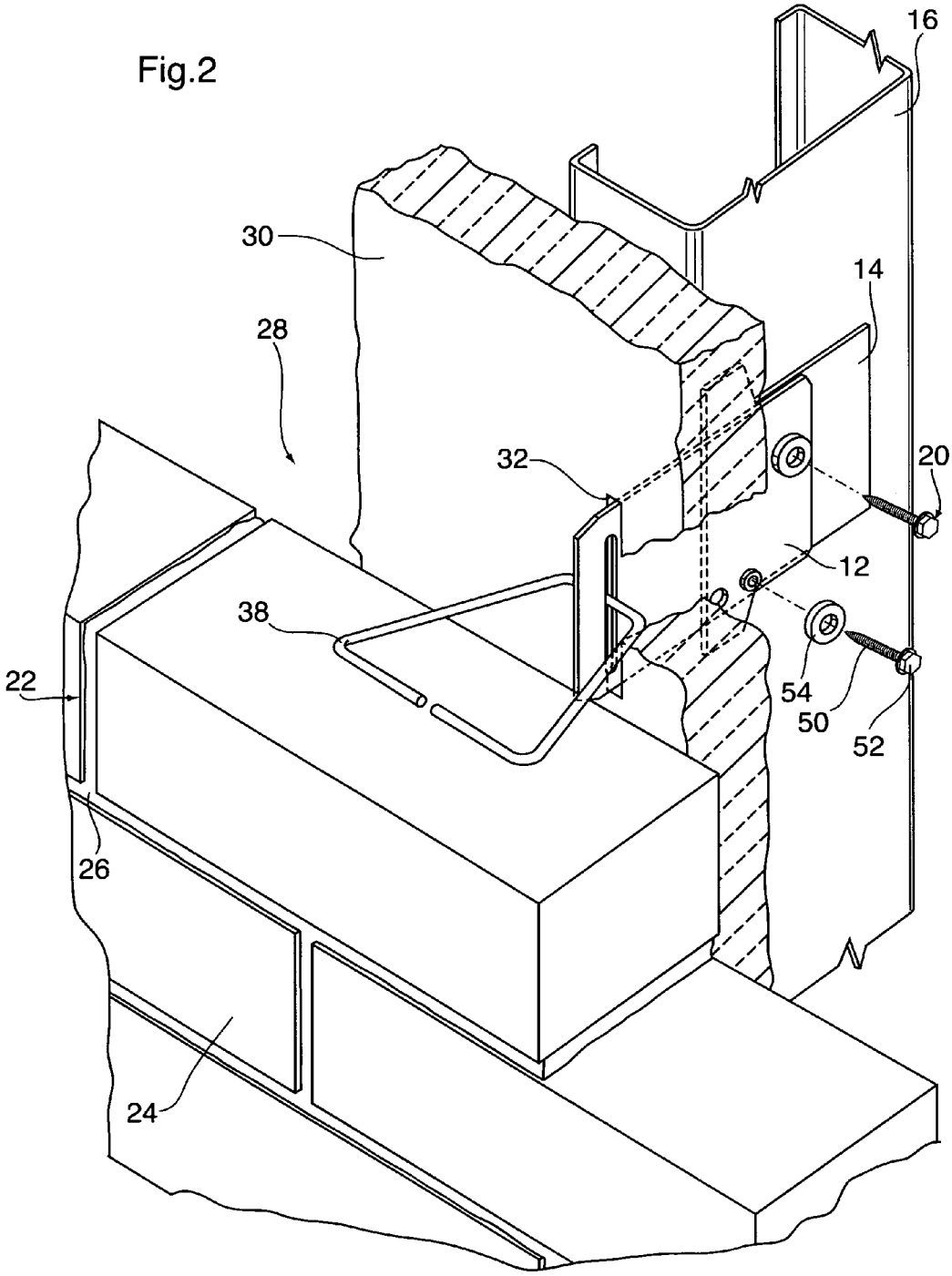
FIG. 2 is a perspective view of the masonry anchor of the present invention being utilized to tie a brick veneer wall to a stud backup wall.
Figure 3:
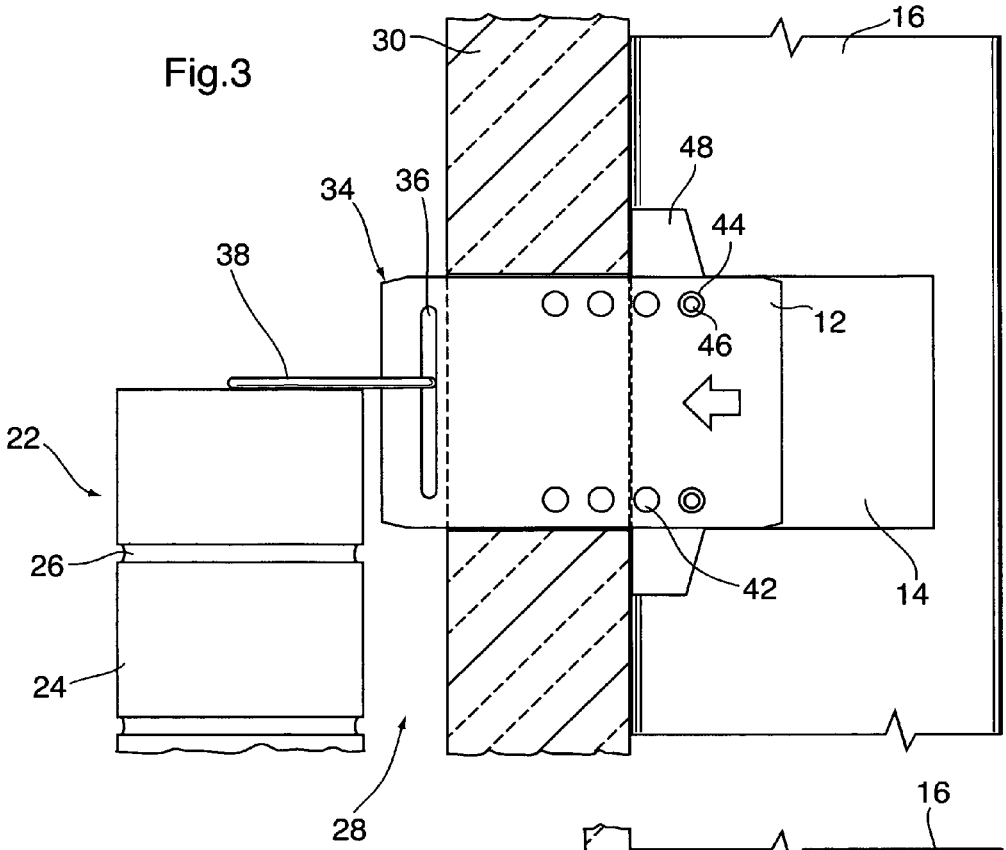
FIG. 3 is a side elevation view of the masonry anchor being utilized with a stud backup wall having a 2" insulation covering.
Figure 4:
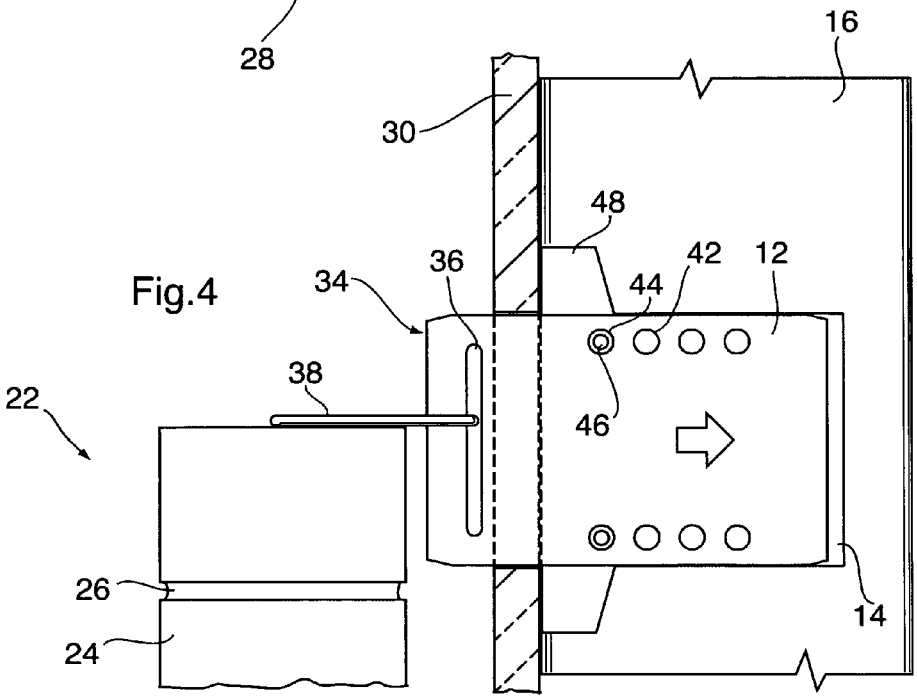
FIG. 4 is a side elevation view of the masonry anchor being utilized in a stud backup with a 0.5" covering.
Figure 5:
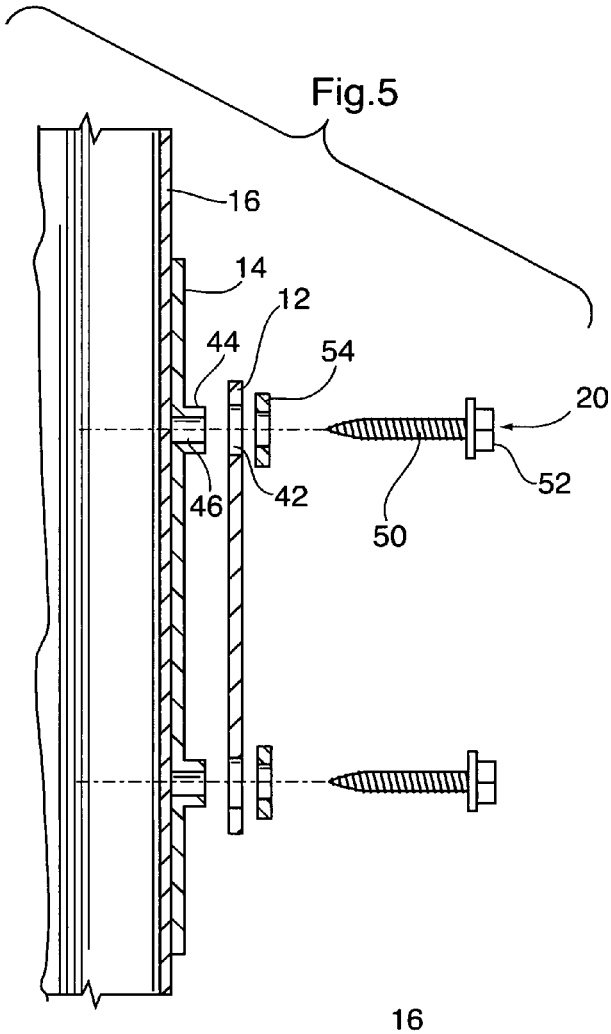
FIG. 5 is an end view in cross-section illustrating the attachment of the masonry anchor to the stud of the stud backup wall.
Figure 6:
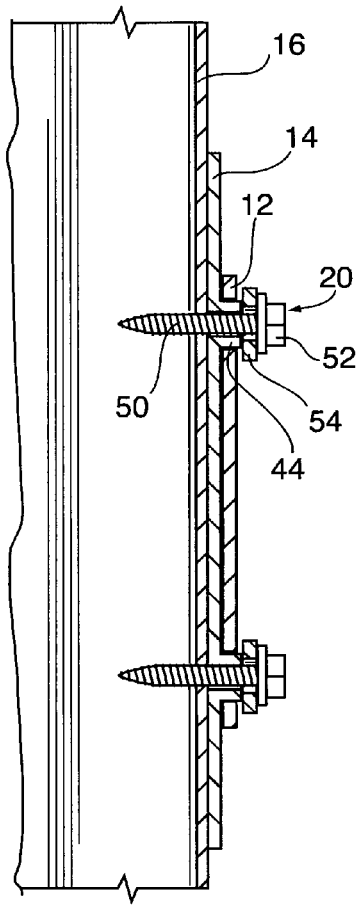
FIG. 6 is an end view in cross-section of the masonry anchor attached to the stud backup wall.
Figure 7:
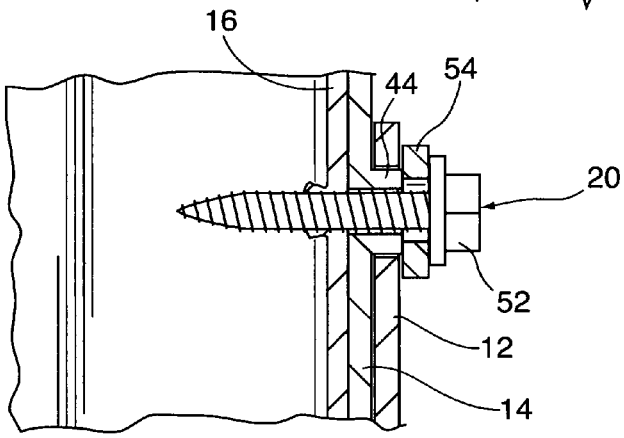
FIG. 7 is an exploded end view in cross-section of one of the fastening means attaching the masonry anchor to the stud backup wall.

The vertically extending slot 36 has a maximum vertical dimension approximately equal to the height of the brick 24 and has a horizontal dimension to allow the tie wire 38 to pass through. The dimensioning of the vertically extending slot 36 allows for adjustability of the positioning of the tie wire 38 in relation to the anchor plate 12 to allow for adjustment based on the location of the brick courses of the brick veneer wall 22. Brick tie wire 28 extends from the coupling end to lie between two courses of bricks 24 in the brick veneer wall 22. After the tie wire 38 is properly positioned as shown in FIGS. 2 through 4, it is mortared between the two courses of bricks 24 of the brick veneer wall 22. In this way the brick veneer wall 22 is securely tied or connected to stud backup wall 18.

It would be considered that the height of the nose portion 34 which accommodates the tie wire slot 36 will depend on the amount of vertical adjustment required to meet variations in the mortaring of the brick veneer wall 22. For example, when erecting large, generally single story buildings such as a shopping mall, the care taken to ensure the evenness of the mortaring is much less than when erecting a multi-story building such as an apartment building. The spacing between floors is precise thus for multi-story buildings such as apartment buildings the tie wire adjustments can be less requiring smaller anchors.

As a practical example for a 3" brick course providing for a full course adjustment the height of the nose portion 34 would be of the order of 4" and the length of the slot 34 would be of the order of 3".

When this degree of adjustment is not required the height of the nose piece 34 for example could be 3" with the length of the slot 36 being 2¼". Again as another example for a nose portion 34 having a height of 2" the length of the slot would preferably be 1¼".

The anchor plate is provided with an anchoring end 40 distal of the coupling end 34 for securing the anchor plate 12 to the stud 16 of the stud backup wall 18. The anchor plate 12 is attached to the stud 16 of the stud backup wall 18 in a manner to permit the outer coupling end 34 to project from the vertically extending slot 36 beyond the outside surface of the backup stud wall 18. This dimension would depend upon the thickness of any covering 30 attached the stud back up wall 18. Generally the coupling end 34 would project the slot 36 about 0.5 inches into the cavity 28 beyond the wall surface. The masonry anchor of the present invention is provided with a means to adapt the anchor to multiple thicknesses of wall coverings without requiring a separate anchor for each individual thickness of wall covering.

The anchoring end 40 of the anchor plate 12 is provided with a plurality of equally spaced holes 42. Preferably holes 42 are provided as 2 lines of vertically aligned holes. Each of these sets of vertically aligned holes 42 are spaced 0.5" apart from the other. In this way, depending upon which set of holes 42 is used for the fastening means 20 when the anchor plate 12 is placed in the proper position, the outer end 34 of the anchor plate 12 illustrated in the figures will project the desired distance beyond the outer covering 30. The embodiment of the masonry anchor 10 illustrated in the figures is for use with wall coverings 30 of the stud back wall 18 which range from a thickness of about 0.5 inches up to 2 inches. Other positioning of the holes farther away from the coupling end would allow the masonry anchor to accommodate other ranges of wall covering thicknesses such as for example, 2½to 4" or greater. This could be accomplished by providing a longer anchor plate with more sets of aligned holes. Alternatively, a longer anchor plate with the same number of sets of aligned holes could be provided with the aligned holes spaced further from the outer end. With changes in the regulations and standards concerning building construction especially in terms of higher energy efficiency buildings, the masonry anchor of the present invention could be easily adapted to cover any thickness of wall covering material which may be desired or mandated.

The proper positioning of the anchor plate 12 is provided by the backing plate 14. The backing plate 14 is constructed of an inert non-conductive material, preferably a plastic such as polyethylene, polyvinyl chloride, polypropylene, etc. The backing plate 14 is provided with annular rings 44, extending from the surface of the backing plate 14. The annular rings 44 are sized to fit within the hole 42 of the anchor plate 12 and are provided with central opening 46 to accept the fastening means 20, to attach the masonry anchor 10 to the stud 16 of the stud backup wall 18.

In order to properly position the anchor plate 12 such that the outer end 34 projects beyond the covering 30 the proper distance, the backing plate 14 is provided with tabs 48 extending upwardly from the upper and lower edges of the backing plate 14 at the forward end thereof. The tabs 48 rest against the surface of the outer covering 30 above and below the slot 32 through which the outer end 34 of the anchor plate 12 projects. This positions the annular rings 44 in the proper position such that when the holes 42 for the thickness of the outer covering align with the annular rings 44, then the outer end 34 of the anchor plate projects the required distance beyond the outer covering.

This alignment is illustrated in FIGS. 3 and 4. In FIG. 3, the thickness of the outer covering 30 is 2" and the aligned holes 42 closest to the rear end of the anchoring end 40 are utilized to overlie and contain the annular rings 44 of the backing plate. In FIG. 4, where the thickness of the outer covering is only 0.5", the aligned holes 42 closet to the front of the anchoring end are utilized. The holes 42 intermediate these two sets of aligned holes 42 would be utilized for outer coverings having thickness of 1" or 1.5".

Once the masonry anchor 10 is properly positioned as described above as well as illustrated in FIGS. 5 to 7, the fasteners 20 are utilized to attach the masonry anchor 10 to the stud 16 of the stud backup wall 18. In order to avoid issues of dissimilar metals, the fastener 20 is constructed of the same metallic material as the stud 16 to which it is to be attached. As the fastener 20 is being attached to the stud 16, the fastener threads and shank 50 pass through the central opening 46 of the annular ring 44 of the backing plate 14 and into the stud 16. In this way, the threads and shank 50 are in contact with the inert material of the backing plate 14 and not the dissimilar metal of the anchor plate 12. In order to prevent contact between the head 52 of the fastener 20 and the surface of the anchor plate 12, an inert washer 54 is provided that lies between the head 52 of the fastener 20 and the surface of the anchor plate 12 when the fastener 20 is fully driven in.

Once the masonry anchor 10 is attached to the stud back up wall 18 as described above, the tie wire 38 is placed within the slot 36 of the outer end 34 of the anchor plate 12 projecting beyond the outer covering 30. The tie wire 38 is then mortared between two rows of bricks 24 of the brick veneer wall 22 to tie the brick veneer wall 22 to the stud backup wall 18.

Figure 8:
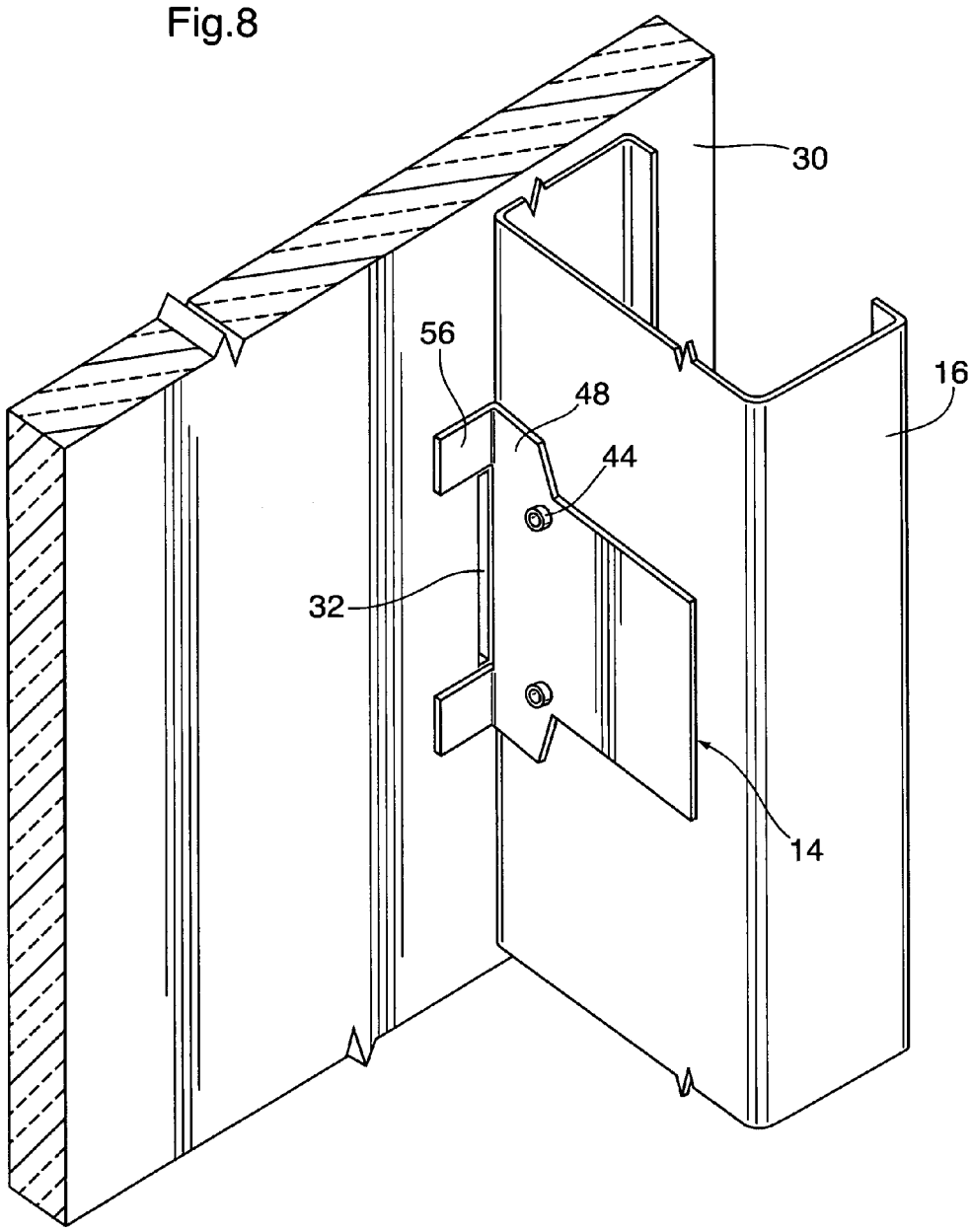
FIG. 8 is a view of a second embodiment of the backing plate of the masonry anchor of the present invention.

A variation of the masonry anchor of the present invention is illustrated in FIG. 8 where the tabs 48 of the backing plate 14 that extend upwardly and downwardly from the upper and lower edges of the backing plate 14 are provided with projections 56 which extend perpendicularly from the forward edges of the tabs 48. The projections 56 provide a more positive engagement and alignment of the backing plate 14 by resting against a larger area of the surface of the outer covering 30 than would be provided by the forward edge of the tabs 48 alone. This could make the installation easier when either the slots 32 cut in the outer covering 30 are larger than required or if the outer covering 30 is a relatively soft material such as certain types of insulating panels.

The masonry anchor 10 of the present invention provides numerous advantages over the prior art arrangements. Firstly by providing the inert materials of the backing plate 14 and washer 54 between the dissimilar metals of the stud 26, fastener 20 and anchor plate 12, the potential of corrosion from dissimilar metal contact is significantly reduced and eliminated.

Secondly, by providing the rows of aligned holes 42 in the anchor plate 12, a single version of the anchor plate 12 is adaptable to different thickness of covering material without having to produce different versions for each individual thickness. This significantly reduces manufacturing costs as it is not necessary to produce a series of dies for a series of anchor plates. Warehousing costs are also reduced as it is no longer necessary to produce and stock numerous different products for the different thicknesses of covering material.

The design of the masonry anchor 10 with the backing plate 14 properly positioning the anchor plate 12 reduces installation time as it is not necessary to measure for the proper positioning of the masonry anchor. Rather, the anchor plate 12 is placed on the backing plate 14 with the annular rings 44 contained within the desired aligned holes 42 for the thickness of the covering material 30. The outer end 34 of the anchor plate 12 is then slid through the slot 32 in the outer covering 30 until the tabs 48 and/or projections 56 of the backing plate 14 rest against the surface of the outer covering 30 and the fasteners 20 with the washers 54 on the shank 50 are driven through the central opening 46 and into the stud 16 of the stud back up wall 18. This properly positions the slot 36 of the outer end 34 of the anchor plate 12 in the proper position beyond the outer covering 30 to accept the tie wire 38 to be mortared into the brick veneer wall 22 and tie the brick veneer wall 22 to the stud back up wall 18.

The use of the combined backing plate and anchor plate where the proper positioning of the masonry anchor is determined by the surface of the covering material attached to the front edge of the stud also allows the masonry anchor of the present invention to be used by any size stud as the positioning is not determined by the depth of the stud. For example, the same masonry anchor could easily be used by the 3⅝" or 5½ metal studs commonly employed for exterior stud back up wall construction. This also reduces manufacturing and warehousing costs.

Although various preferred embodiments of the present invention have been described herein in detail, it would be appreciated by those skilled in the art that variations may be made thereto without departing from the spirit of the invention or the scope of the appended claims.

The embodiments of the invention in which an exclusive property or privilege is claimed are defined as follows:

1. A stud back-up wall for tying a masonry veneer wall to the stud back-up wall, the stud back-up wall comprising a plurality of parallel spaced apart studs being connected at the top and bottom by a top plate attached to the ceiling and a bottom plate attached to the floor, each of the studs being generally C-shaped having parallel space apart flanges connected by a central web one of the flanges being oriented towards the masonry veneer wall and the other flange being oriented towards the interior space, the stud back-up wall being provided with a plurality of masonry anchors comprising a generally planar anchor plate of corrosion resistant steel with an outer coupling end projecting beyond the stud back-up wall and having a slit adjacent an outer edge of the outer coupling end to hold a veneer tie wire for insertion between courses of the masonry wall to tie the masonry wall back to the stud back-up wall, the anchor plate also having an inner anchoring end secured to a web of the stud of the stud back-up wall, the anchor plate having a plurality of holes therethrough in the inner anchoring end accepting a fastening means fastening the anchor plate to the web of the stud of the stud back-up wall, a backing plate of an inert non-conducting material positioned between the inner anchoring end of the anchor plate and the web of the stud of the stud back-up wall, the backing plate having raised structures on a face thereof sized and being contained within the holes in the inner anchoring end of the anchor plate, a shank of the fastening means passing through the raised structure to attach the inner anchoring end of the anchor plate to the web of the metal stud without the fastening means contacting the inner anchoring end of the anchor plate.

2. The stud back-up wall as claimed in claim 1 wherein the stud back-up wall is provided with an outer covering having an inner surface facing the stud back-up wall and an outer surface facing the masonry veneer wall.

3. A stud back-up wall as claimed in claim 2 wherein the backing plate is provided with upwardly and downwardly extending tabs on an upper and lower edge respectively at a forward end of the backing plate for engaging the inner surface of the outer covering of the stud back-up wall to provide for proper spacing of the coupling end of the connected anchor plate from the stud back-up wall.

4. A stud back-up wall as claimed in claim 3 wherein the corrosion resistant steel is stainless steel.

5. A stud back-up wall as claimed in claim 4 wherein the plurality of holes in the inner anchoring end comprises a plurality of rows of aligned holes equally spaced along the inner anchoring end to accommodate varying thickness of outer covering of the stud back-up wall.

6. A stud back-up wall as claimed in claim 5 wherein the rows of aligned holes in the inner anchoring end are spaced ½ inch away from each other.

* * * * *